US005157370A

United States Patent [19]

Engelbach et al.

[11] Patent Number: 5,157,370

[45] Date of Patent: Oct. 20, 1992

[54] TRIP FREE THERMOSTAT

[75] Inventors: Brian W. Engelbach; Douglas P. Versaw, both of Mansfield, Ohio

[73] Assignee: Therm-O-Disc, Incorporated, Mansfield, Ohio

[21] Appl. No.: 827,263

[22] Filed: Jan. 29, 1992

[51] Int. Cl.[5] ..... H01H 37/70; H01H 37/52

[52] U.S. Cl. ..... 337/348; 337/354; 337/56

[58] Field of Search ..... 337/74, 348, 367, 56, 337/342, 354

[56] References Cited

U.S. PATENT DOCUMENTS 2,911,503 11/1959 Garbers ..... 337/56

3,378,658 4/1968 Arlin et al. ..... 337/56

*Primary Examiner*—Harold Broome

*Attorney, Agent, or Firm*—Jones, Day, Reavis & Pogue

[57] ABSTRACT

A manually resettable trip free thermostat that has simple construction and a pivotable stationary contact arm that enables the thermostat to be reset while maintaining the contacts in an open condition.

8 Claims, 2 Drawing Sheets

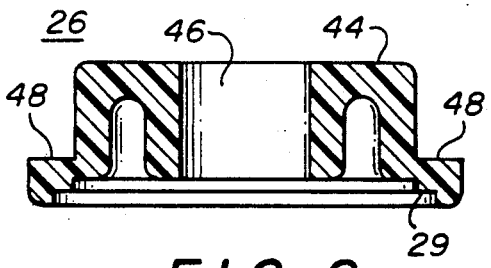
FIG. 8
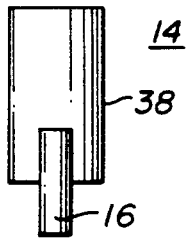
FIG. 5
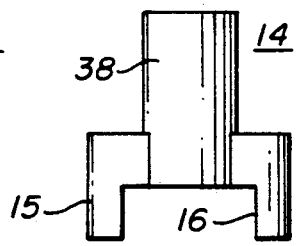
FIG. 6
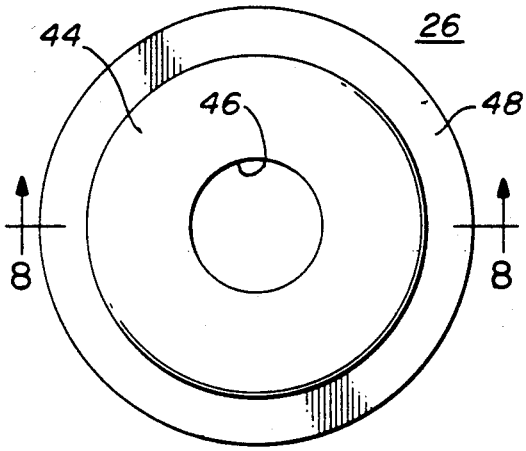
FIG. 9
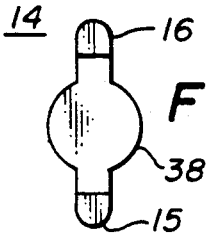
FIG. 7
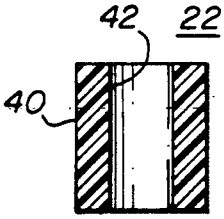
FIG. 10
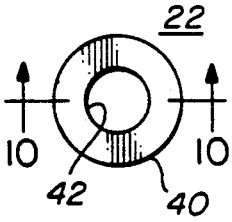
FIG. 11
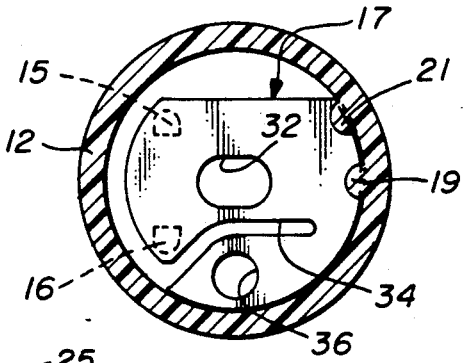
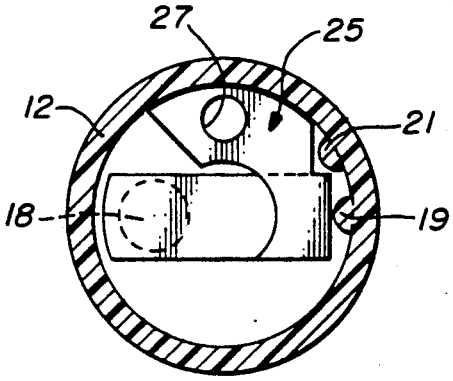
FIG. 13
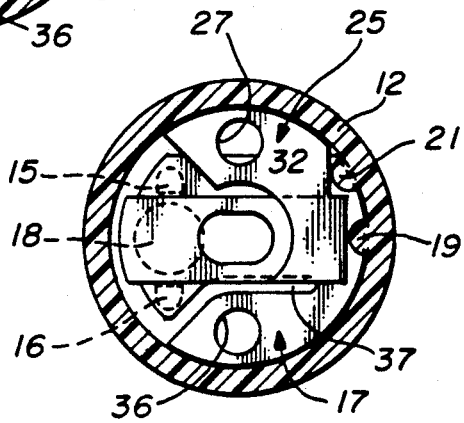
FIG. 14

TRIP FREE THERMOSTAT

FIELD OF THE INVENTION

The present invention relates in general to a resettable thermostat to be used as an overtemperature protection device on gas and electric home heating furnaces and in particular to such a thermostat wherein the thermostat switch contacts are held in the open position during the reset operation.

BACKGROUND OF THE INVENTION

Thermostatically controlled switches are well known in the art and are used as overtemperature protection devices on equipment such as gas and electric home heating furnaces, clothes dryers, electric motors, and other electrical equipment which could be damaged due to overheating. In the past, it has been possible for operators to hold the manually reset button in a position so as to maintain the contacts of the switch in the closed position. This of course could cause damage to already overheated equipment.

Such switches are presently required to be designed such that if the reset button is actuated, the contacts will be held in the open position, thus preventing the electrical circuit from being completed until the reset button is released.

Such prior art devices are known but they are very complex in construction or are constructed such that they quickly become unusable. U.S. Pat. No. 3,219,783 discloses a simple thermostatic control switch in which it is possible that the resilient movable arm can be bent or warped by operation of the reset button, thus changing the position of the movable contact with respect to the fixed contact such that eventually when the button is released, the contacts do not close as required to complete the circuit. A more complicated device is disclosed in U.S. Pat. No. 4,117,443. See also U.S. Pat. No. 5,003,282.

The present invention overcomes the disadvantages of the prior art by providing a thermostat with a less number of parts and with a simple positive action that prevents the contacts from being closed during the reset operation.

The thermostat of the present invention has a plastic reset button inserted through a hole in the switchcase housing. The end of the button is forked, having two prongs that extend on either side of the movable contact arm within the housing. The stationary contact arm is attached to the housing so as to be biased into contact with the prongs. Two stops that are molded in the switchcase contact and hold in position one end of the stationary contact arm in a pivotable relationship. The stationary contact arm is also held in place by a rivet through the case or housing of the switch. The prongs of the reset button and the stops establish a base plane for selecting the proper length of a bumper unit for the assembly. When the operating temperature of a bimetal disc is achieved, it inverts from a first bowed position to a second bowed position so as to push the bumper unit which opens the switch by separating the stationary and movable contacts. The bimetal disc is made such that it cannot reset by itself at normal ambient temperatures. The disc must be pushed back to its initial position using the reset button. When the reset button is pressed, the prongs on the button pivot the stationary contact away from the movable arm about the switchcase stops. The pivotal stationary contact arm pushes on one end of a sleeve that surrounds the bumper. The other end of the sleeve snaps the bimetal disc back to its initial position. As the stationary contact arm continues its pivotal movement, it moves towards a shield that is used as a stop and, as it does, the movable arm comes to rest on the bumper unit preventing any further movement of the movable arm. As the stationary contact arm continues to pivot, the contacts remain open as the disc snaps back because the movable arm is held or limited in its travel by the bumper unit. The contacts cannot reclose until the reset button is released, thus allowing the pivotal stationary contact to spring back to its initial position. Any pressure applied to the button before the disc trips separates the contacts causing a temporary off condition. The shield described earlier acts as a stop for the stationary arm to prevent overbending it during reset. The shield also acts as a guide for the sleeve and bumper unit and contains a recess for the bimetal disc.

Thus it is an object of the present invention to provide a thermostat having a bimetallic snap disc which will open the contacts when a predetermined temperature is reached and which provides for a temporary opening of the contacts when a reset button is pushed or depressed.

It is also an object of the present invention to provide a resettable thermostat in which, after the contacts have been opened by a snap disc at a predetermined temperature, the contacts cannot be reclosed when the reset button is depressed even though the temperature has allowed the bimetallic snap disc to be forced to be returned to its first bowed position. The reset switch must be released before the contacts will reclose.

It is still another important object of the present invention to provide a resettable thermostat switch in which a fixed contact arm is pivotal about one end thereof and is responsive to movement of the reset button such that when the reset button is depressed, the pivotal fixed contact arm is moved away from the movable contact arm, thus preventing the contacts from closing so long as the reset button is depressed.

It is still another object of the present invention to provide a bumper plunger in contact with the bimetallic snap disc and the movable contact arm to open the contacts when a predetermined temperature is reached and to limit movement of the movable contact arm when the thermostat is being reset.

It is yet another object of the present invention to provide a sleeve around the bumper or plunger assembly which is forced into contact with the pivotable fixed contact arm when the bimetallic snap disc changes its bowed position and which resets the bimetallic snap disc when the reset button is depressed.

It is also an object of the present invention to provide a shield for the stationary arm that acts as a stop to prevent overbending the pivotable stationary arm during the reset process. The shield also acts as a guide for the sleeve and the bumper plunger assembly and contains a recess for the bimetallic disc.

SUMMARY OF THE INVENTION

Thus the present invention relates to a manually resettable trip free thermostat switch comprising a housing, a pivotable fixed contact arm and a movable contact arm attached to the housing, the movable contact arm being resiliently biased into a first position physically contacting the fixed contact arm below a predetermined temperature to complete an electrical circuit and having a second position physically apart from the fixed contact arm at or above the predetermined temperature to open the electrical circuit and manually operated reset means in the housing contacting the pivotable fixed contact arm for pivoting the fixed contact away from the movable contact during manual reset to maintain the open circuit so long as the reset means is manually operated and allowing the electrical circuit to be completed only when the reset means is manually released.

BRIEF DESCRIPTION OF THE DRAWINGS

These and other objects of the present invention will be more fully understood when taken in conjunction with the following detailed description of the drawings and the drawings in which:

FIGS. 5, 6 and 7 are side, front and bottom views, respectively, of the reset button illustrating the forked prongs that are used to straddle the movable contact and engage the pivotable contact arm;

FIG. 8 is a cross-sectional view of the shield which has an orifice for receiving the sleeve and bumper assembly;

FIG. 9 is a top view of the shield illustrated in FIG. 8;

FIGS. 10 and 11 are cross-sectional and top views, respectively, of the sleeve;

FIG. 12 is a simplified top cross-sectional view of the thermostat taken just above the pivotable contact arm;

FIG. 13 is a simplified cross-sectional view of the thermostat taken just above the movable contact arm to illustrate the construction of the movable contact arm; and FIG. 14 is a simplified cross-sectional view of the thermostat taken above the movable contact arm to illustrate both the movable contact arm and the pivotable fixed contact arm in relation to each other.

DETAILED DESCRIPTION OF THE DRAWINGS

Figure 1:
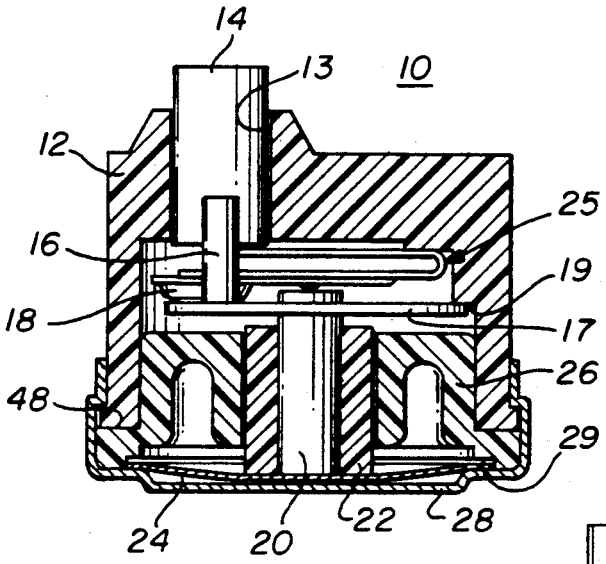
FIG. 1 is a partial cross-sectional view of the novel resettable trip free thermostat when the contacts are in the normally closed position.

As can be seen in FIG. 1, which is a partial cross-sectional view of the novel thermostat 10, a plastic reset button 14 is inserted through an orifice 13 in housing 12. The lower end of the button 14 is forked having two prongs 15 and 16, more clearly shown in FIGS. 6 and 7, that extend on either side of a movable contact arm 25 having contact 18 thereon. A stationary contact arm 17 is attached to the housing so as to be biased into contact with the prongs 15 and 16. Two stops 19 and 21 shown most clearly in FIG. 14 are molded into the switchcase and contact one end of the stationary contact arm 17. The stationary contact arm 17 is held in place by any well-known means such as a rivet extending through orifice 36, shown in FIG. 4 and FIGS. 12 and 14. Electrical contact can be made to the outside of the housing from this point in any well-known manner. The prongs 15 and 16 and the stops 19 and 21 establish a base plane for selecting the proper length of a bumper unit or plunger 20 for the assembly 10. When the operating temperature of a bimetallic disc 24 is achieved, the disk inverts from a first bowed position shown in FIG. 1 to a second bowed position shown in FIG. 2 so as to push the bumper or plunger 20 which opens the switch 10 by separating the stationary and movable contacts that are on arms 17 and 25 respectively. The bimetallic disc 24 is made such that it cannot reset itself at normal ambient temperatures. Such bimetallic discs are well known in the art. The bimetallic disc 24 must be forced back to its initial bowed position using the reset button 14.

When the reset button 14 is depressed, the prongs 15 and 16 on the reset button 14 pivot the stationary contact arm 17 away from the movable contact arm 25 about stops 19 and 21. The stationary contact arm 17, as it moves, pushes on one end of a sleeve 22 that surrounds the bumper or plunger 20. The other end of the sleeve contacts the bimetal disc 24 and, if it has snapped to its second bowed position, snaps it back to its initial or first bowed position. As the stationary contact arm 17 contacts a shield 26 that is used as a stop, the movable contact arm 25 comes to rest on the upper end of the bumper or plunger 20, thus limiting and preventing its further movement. As the stationary contact arm 17 continues to pivot, the contacts 17 and 18 remain open even though the disc 24 snaps back to its original position because the movable arm 25 is held in place by the bumper or plunger 20. The contacts cannot reclose until the reset button 14 is released, thus allowing the stationary contact arm 17 to spring back to its original position. Any pressure applied to the reset button 14 before the bimetal disc 24 moves from its first bowed position to a second bowed position because of a critical temperature causes the contacts to separate and create a temporary open circuit condition. The shield 26 described earlier acts as a stop for the stationary arm 17 to prevent over bending it during reset. The shield 26 also acts as a guide for the sleeve 22 and the bumper or plunger 20 and contains a recess 29 for the bimetal disc 24.

Figure 2:
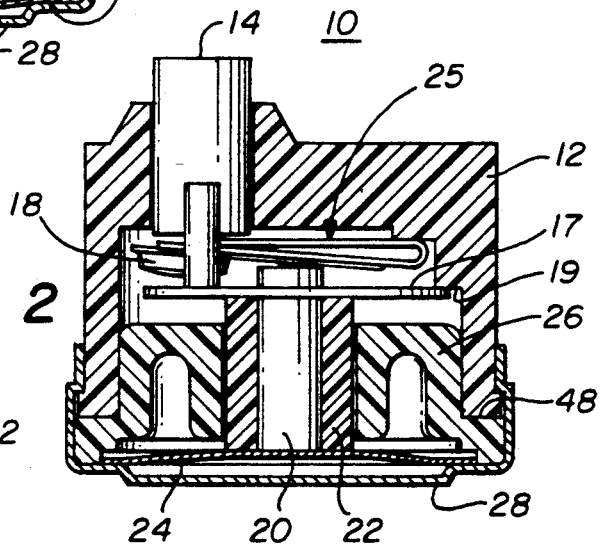
FIG. 2 is a partial cross-sectional view of the novel resettable trip free thermostat when the temperature has exceeded its limits and the contacts have been forcibly opened.

Thus, in FIG. 1, the contacts are in their normally closed position and the bimetallic disc 24 is in its first bowed position. Both the bumper 20 and the sleeve 22 are in contact with the bimetallic disc 24. This is the normal operating condition. When a temperature increase is detected beyond a predetermined amount, the bimetallic snap disc 24 snaps to its opposite or second bowed position as illustrated in FIG. 2. When it does, it moves the bumper 20 and sleeve 22 upwardly. The bumper 20 engages the movable contact arm 25 forcing contact 18 away from the pivotable fixed contact arm 17, thus opening the circuit. Simultaneously, the sleeve 22 is moved into contact with the pivotable fixed contact arm 17. The electrical circuit is now open. The bimetallic snap disc 24 is so constructed that it will not resume its first bowed position upon the temperature decreasing to the normal temperature below the predetermined temperature. It must be forced down to its initial position by depressing reset button 14.

Figure 3:
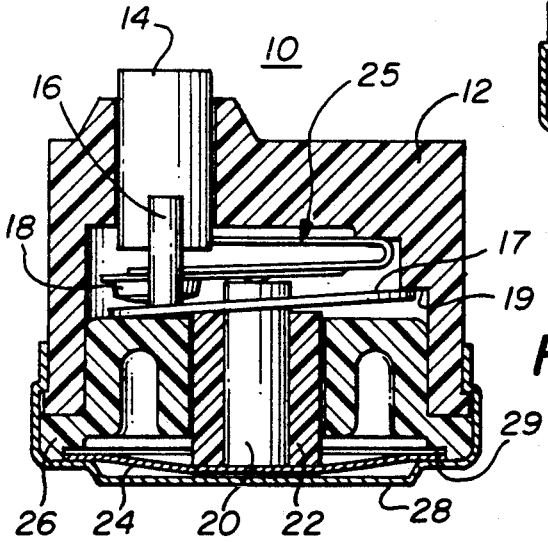
FIG. 3 is a partial cross-sectional view of the novel resettable trip free thermostat in its reset condition illustrating that when the thermostat has been reset and the reset button is depressed, the contacts are open as long as the reset button is depressed.

As illustrated in FIG. 3, when the reset button 14 is depressed, the prongs 15 and 16 that are engaged with one end of the pivotable contact arm 17 force it downward, thus pivoting it about the other end which is under stops 19 and 21 as best illustrated in FIG. 12. As the outer end of the fixed pivotable contact arm 17 is moved downwardly by prongs 15 and 16, the sleeve 22 is forced downwardly against snap disc 24 thus returning it to its original position. Note, however, that movable contact arm 25 is limited in its downward movement by the upper portion of bumper 20. Thus it cannot go downward any further and there remains a gap or separation between contact 18 and pivotable contact arm 17 causing the circuit to remain open even though the reset button is depressed.

If the temperature has not decreased to a point below the predetermined temperature, upon release of the reset button 14, the bimetallic element 24 simply snaps back to its opposite bowed position continuing to keep the switch open. If the temperature has fallen below the predetermined temperature, release of the reset button 14 allows the fixed pivotable contact arm 17 to spring back to its original position as illustrated in FIG. 1 such that it contacts the movable arm 25.

When the switch is in its normal operating condition as illustrated in FIG. 1, if the reset button is depressed, the contacts are simply opened as illustrated in FIG. 3 and remain open until the reset button is released. Upon release of the reset button the circuit is again closed and the controlled unit continues to operate.

Figure 4:
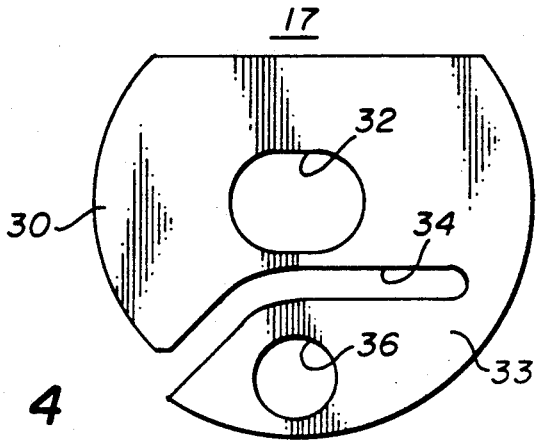
FIG. 4 is a plan view of the pivotable contact arm.

The normally fixed but pivotable contact arm 17 is illustrated in FIG. 4. It comprises a plate 30 that is substantially circular in appearance and which has an oval orifice 32 therein for receiving the bumper or plunger 20. Orifice 36 is used to attach the plate 17 to the housing 12 in any well-known manner such as by a rivet. The electrical contact to the contact arm 17 can be made at this point. A slot 34 separates the plate 30 into two major portions. The smaller portion is held in fixed relationship to the housing by the rivet or other attaching means through orifice 36. The larger portion of plate 30 can pivot downwardly by virtue of the prongs on the reset button 14 as illustrated in FIG. 12. The plate 30 that is used as a stationery contact is formed of a material such that it will not lose its resiliency when the larger portion of the plate is forced downwardly by the reset button 14 as illustrated in FIG. 3. The plate 30 can bend a slight amount in the area 33 that connects the large and small sections separated by the gap 34 and still retain its resiliency.

The plunger 14 is illustrated in FIGS. 5, 6 and 7. It has a circular body portion 38 with two prongs 15 and 16 extending from each side thereof in a forked manner as illustrated in FIG. 6. It is the prongs 15 and 16 that straddle the movable contact arm 25 and engage the fixed pivotable contact arm 30.

FIG. 8 is a cross-sectional view of the shield which acts as a stop for the stationary arm 17 to prevent overbending it during reset. Thus, as can be seen in FIG. 3, when the reset button 14 is depressed to the maximum extent, the end of the pivotable fixed arm 17 rests on shield 26 and thus resists being bent by the pressure from the reset button 14. In addition, the shield 26 also acts as a guide for the sleeve 22 and the bumper or plunger 20 as can be seen in FIGS. 1, 2 and 3 and also contains a recess 29 for receiving the bimetal disc 24. The orifice 46 illustrated in FIGS. 8 and 9 receives the sleeve 22 with the plunger 20 therein. The shoulder 44 acts as the stop for the stationary arm 17 to prevent over bending it as described earlier.

The sleeve 22 is illustrated in cross-section in FIG. 10 and in a top view in FIG. 11. As can be seen, it is simply a hollow cylinder in shape.

FIG. 12 is simply a schematic representation of a cross-section of the thermostat 10 taken just above the fixed pivotable arm 17 disclosed earlier in FIG. 4. It will be noted that the arm 17 is biased into contact with the prongs 15 and 16 of the reset button 14 (illustrated by dashed lines in FIG. 12) with the use of the two stops 19 and 21 that are molded into the switch case 12 to engage one end of the stationary contact arm 17 as illustrated in FIGS. 1, 2 and 3. The orifice 32 receives the plunger 20. The arm 17 is attached to the housing 12 in any well-known manner, including for example, rivets or other means through orifice 36. As pointed out earlier, the electrical connection to the out side of the housing 12 can be made at this point.

FIG. 13 is a diagrammatic representation of a cross-section of the thermostat 10 taken above the movable contact arm 25 to show the manner in which the arm 25 is mounted within the housing 12. Again a rivet or other fastening device may be inserted through orifice 27 to attach the arm 25 to the housing 12.

FIG. 14 is a schematic representation of a cross-sectional view of the thermostat 10 taken above the movable contact arm 25 and illustrating the physical relationships of the movable contact arm 25 and the fixed pivotable contact arm 17.

Thus, there has been disclosed a novel thermostat having a plastic reset button inserted through a hole in the insulated switch case or housing. The end of the reset button is forked and has two prongs that extend on either side of the movable contact arm. The stationary contact arm is attached to the housing so as to be biased in contact with the reset button prongs. Two stops are molded into the switch case and engage one end of the stationary contact arm. The stationary contact arm is held in place by a rivet or other means through the housing. The prongs and stops establish a base plane for selecting the proper length of a bumper or plunger for the assembly. When the operating temperature of the bimetal disc is achieved, it inverts so as to push the bumper which opens the switch by separating the stationary and movable contacts. The bimetal disc is made such that it cannot reset by itself at normal ambient temperatures. The disc must be forced back to its initial position using the reset button. When the reset button is depressed, the prongs on the button pivot the stationary contact away from the movable contact arm. At the same time, the stationary contact arm pushes on one end of the sleeve that surrounds the bumper. The other end of the sleeve snaps the bimetal disc back into its initial position. As the stationary contact arm pivots, it moves toward a shield that is used as a stop and the movable arm comes to rest on the bumper. As the stationary contact arm continues to pivot, the contacts remain open as the disc snaps back to its original position because the movable arm is held by the bumper. The contacts cannot reclose until the reset button is released thus allowing the stationary contact to spring back. Any pressure applied to the reset button before the disc trips separates the contacts causing a temporary off condition. The shield described earlier acts as a stop for the stationary arm to prevent over bending it during reset conditions. The shield also acts as a guide for the sleeve and bumper and contains a recess for the bimetal disc.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A manually resettable trip free thermostat switch comprising:

a housing;

a pivotable fixed contact and a movable contact attached to the housing;

a bimetallic snap disc movable from a first position to a second position at a predetermined temperature, the snap disc resiliently biasing the movable contact into a first position physically contacting the fixed contact below the predetermined temperature to complete an electrical circuit and into a second position physically apart from the fixed contact at or above the predetermined temperature to open the electrical circuit; and manually operated reset means in the housing contacting the pivotable fixed contact for pivoting the fixed contact away from the movable contact and returning the bimetallic snap disk to its first position during manual reset so as to maintain the open circuit as long as the reset means is manually operated and allowing the electrical circuit to be completed only when the reset means is manually released.

2. A thermostat switch as in claim 2 further comprising:

a resilient elongated arm having the movable contact on one end thereof;

a movable plunger contacting the resilient arm; and the bimetallic snap disc movable between first and second bowed positions and contacting the movable plunger such that in the first bowed position below the predetermined temperature, an electrical circuit is closed and at or above the predetermined temperature, the snap disc moves to the second bowed position and forces the plunger to separate the movable contact from the fixed contact to open the electrical circuit.

3. A thermostat switch as in claim 2 further comprising:

an elongated plate having the fixed contact on one end thereof; and a sleeve surrounding the plunger, said sleeve being movable by the snap disc from a first position separated from the pivotable fixed contact to a second position in engagement with the pivotable fixed contact.

4. A thermostat switch as in claim 3 wherein the manual reset means comprises:

a reset button contacting the pivotable elongated plate having the fixed contact; and a stop on the housing contacting the other end of the elongated plate such that when the reset button is depressed, the elongated plate is pivoted about the one end to move the fixed contact away from the movable contact when the snap disc is in the first bowed position and cause the open electrical circuit only so long as the reset button is activated and when the disc is in the second bowed position to maintain the open circuit until the snap disc is returned to the first bowed position and the reset button is released.

5. A thermostat switch as in claim 4 further comprising:

the plunger having a length sufficient to allow the fixed and movable contacts to close in the first bowed position of the snap disc and to separate the fixed and movable contacts in the second bowed position of the snap disc; and a shield in the housing surrounding the sleeve, the shield having a height in relation to said plunger sufficient to limit the pivotal movement of the fixed contact to prevent overbending thereof while enabling the plunger to keep the contacts separated to open the electrical circuit when the snap disc is in the first bowed position and the reset button is activated.

6. A thermostat switch as in claim 3 wherein the elongated plate containing the fixed contact and the resilient arm containing the movable contact are formed of an electrically conducting material.

7. A thermostat switch as in claim 3 wherein the elongated plate is formed of a material such that the plate will not over-bend when the reset button is operated.

8. A trip free thermostat comprising:

a housing;

fixed and movable electrical contacts in the housing, the movable contact being resiliently biased toward the fixed contact to cause a normally completed electrical circuit;

a movable plunger operatively associated with the movable contact;

a thermally responsive snap disc for moving the movable plunger to force the movable contact away from the fixed contact when the thermostat is subject to a predetermined temperature to open the normally completed circuit;

reset means for enabling the thermostat contacts to be reset to the closed position at a temperature below the predetermined temperature, the reset means allowing the biased movable contact to move toward the fixed contact while simultaneously allowing the fixed contact to move away from the movable contact during the reset operation thus maintaining a continual separation of the fixed and movable contacts until the reset means is released;

a sleeve surrounding the plunger, the sleeve being movable by the snap disc from a first position separated from the pivotable fixed contact to a second position in engagement with the pivotable fixed contact;

a reset button engaging the fixed contact; and a stop on the housing such that when the reset button is depressed, the fixed contact is moved away from the movable contact when the snap disc is in the first bowed position to cause the open electrical circuit only so long as the reset button is activated and when the disc is in the second bowed position maintains the open circuit until the snap disc is returned to the first bowed position and the reset button is released.

* * * * *